United States Patent [19]

Cruzen et al.

[11] 4,036,570

[45] July 19, 1977

[54] CEMENTITIOUS PRODUCT MAKING SYSTEM WITH PRODUCT HEIGHT GAUGING MECHANISM

[75] Inventors: Harry F. Cruzen; Robert W. Gresham, both of Alpena, Mich.

[73] Assignee: Besser Company, Alpena, Mich.

[21] Appl. No.: 732,388

[22] Filed: Oct. 14, 1976

Related U.S. Application Data

[60] Continuation of Ser. No. 684,154, May 7, 1976, abandoned, which is a division of Ser. No. 475,757, June 3, 1974, Pat. No. 3,963,397.

[51] Int. Cl.[2] ..... B28B 1/08

[52] U.S. Cl. ..... 425/141; 425/140; 425/219; 425/163

[58] Field of Search ..... 425/140, 141, 163, 219

[56] References Cited

U.S. PATENT DOCUMENTS

| | | | |
|---|---|---|---|
| 2,957,221 | 10/1960 | Zinania et al. | 425/219 X |
| 2,957,222 | 10/1960 | Zinania et al. | 425/219 |
| 3,371,770 | 3/1968 | Graham et al. | 425/141 X |
| 3,640,660 | 2/1972 | Mets | 425/141 |
| 3,679,340 | 7/1972 | Springs | 425/163 |
| 3,866,115 | 2/1975 | Lewis | 425/141 X |

*Primary Examiner*—J. Howard Flint, Jr.
*Attorney, Agent, or Firm*—Learman & McCulloch

[57] ABSTRACT

A concrete product making machine having a product forming mold with a cavity for receiving cementitious material; support surfaces such as pallets on which the formed products are supported; a transfer device by which "green" products or blocks are removed on their pallets from the vicinity of the mold; a block height gauging device, downstream of the mold, for gauging the height of the products by gauging the distance from the top surfaces of the pallets to the top surfaces of the products; and mechanism controlling the volume of material delivered to the mold accordingly.

7 Claims, 3 Drawing Figures

30
31
29
60
46
48
68
76
70
58
56
54
44
66
74
90
69
88
78
86
80
82
84
50
52
40
42
38
18a
41
39
34
32
g
64
62
24
28
22
F
B
18
101
39a
39b

L1
L2
L3
L4
L5
L6
L7
L8
68
94
95
105
92
93
70
72
71
74
20
97
14
96
13
10
12
E
18
16
17
a
80
84
B
M
110
104
106
62a
62b

CEMENTITIOUS PRODUCT MAKING SYSTEM WITH PRODUCT HEIGHT GAUGING MECHANISM

BACKGROUND OF THE INVENTION

This application is a continuation of application Ser. No. 684,154, filed May 7, 1976, and now abandoned, which application is a division of application Ser. No. 475,757, filed June 3, 1974, now Pat. No. 3,963,397.

In the manufacture of concrete building blocks, it is important for a variety of reasons that the blocks be uniform in size and density. In the subsequent laying of blocks, height of the blocks becomes particularly important because the blocks must be laid in level courses.

In one block making machine which has been proposed, the heights of the blocks were gauged from the under surfaces of the pallats on which the blocks were supported. In such a machine, the thickness of the pallet affects the heights measured. For example, a block formed on a thick pallet will appear to have less height than a block formed on a thiner pallet. Accordingly, efforts were made to develop apparatus for gauging the height of the block independently of pallet thicknesses. One such machine includes apparatus for measuring the block height by gauging the distance from the top of the pallet while the mold is being vibrated. In this machine the vibration introduces another variable which affects the heights measured and negates some of the advantage resulting from gauging the block height independently of the pallet. Accordingly, it is an important concept of the present invention to provide a block-engaging apparatus, connected with mechanisms for controlling the volume of material delivered to the mold, which gauges the heights of the blocks formed by measuring the distance from the top of each block supporting pallet to the tops of the blocks thereon at a time when the blocks are not being vibrated.

Other objects and advantages of the present invention will become apparent to those of ordinary skill in the art as the description thereof proceeds.

BRIEF SUMMARY OF THE INVENTION

A concrete product or block manufacturing machine with height gauging apparatus for gauging the height of a "green" block supported on a pallet by gauging the distance between the top of a block supporting pallet and the top of the product including: a frame; a support vertically movable on the frame between a raised, inoperative position and a lower, pallet top sensing position at a level dependent upon the level of the top of the pallet; a block top sensor mounted on the support for vertical movement relative thereto, to a level dependent upon the height of the formed block, and mechanism controlled by the sensing mechanism for controlling the volume of material delivered to the mold.

The present invention may more readily be understood by reference to the accompanying drawings in which.

Figure 3:
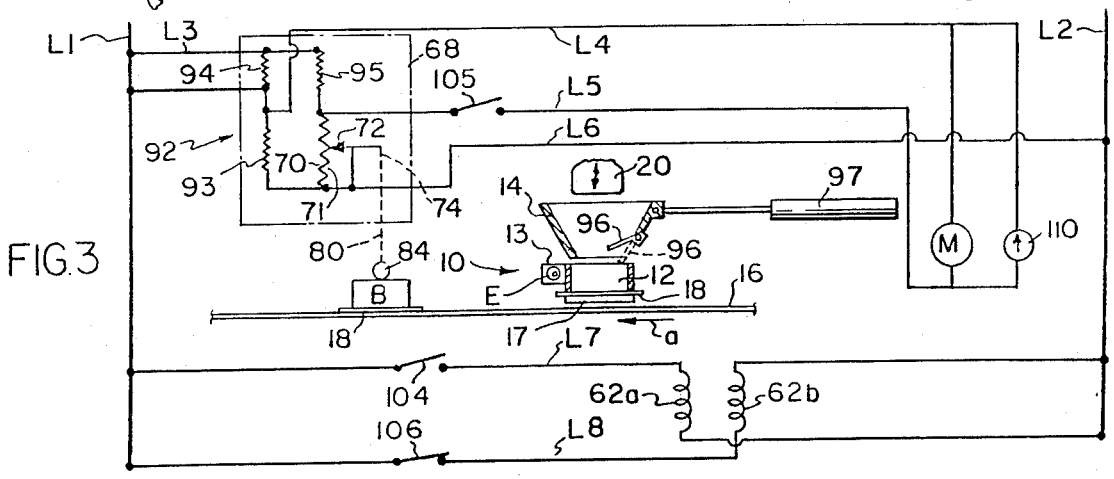
FIG. 3 is a schematic diagram, illustrating a control circuit for controlling apparatus constructed according to the present invention.

Referring initially to FIG. 3, a block forming machine is schematically designated 10 and is of a construction more particularly illustrated in either of the present assignee's U.S. Pat. Nos. 2,957,222 or 3,679,340, which are incorporated herein by reference. A concrete block forming machine 10 includes a vibratile mold box 12, open at its upper and lower ends or sides and vibrated by an eccentric shaft device E. A pallet conveyor, generally designated 16, is provided for moving block supporting pallets 18 successively into a position at the under side of the mold box 12 as described more particularly in the referenced patents. Also provided is a vertically movable pallet support frame 17, situated between the belts of conveyor 16, to move the pallet 18 upwardly off the conveyor 16 into engagement with the underside of mold box 12. A cementitious material feed box 14 is slidably movable in a to-and-fro path between a remote or removed material receiving position and a material discharge position, over the mold box 12, in which it delivers cementitious thereto.

As the feed box 14 is withdrawn, the mold box 12 is vibrated for a predetermined time via vibrating mechanism 13, to cause the cementitious material to settle and a stripper head, generally designated 20, is thereafter lowered into engagement with the vibrating material in the mold cavity and form the block to its proper height. When the block is formed to the proper height, the vibration is interrupted and the stripper head 20 will continue to move the side-by-side blocks B (FIG. 1), downwardly toward the underlying pallet conveyor 16.

As the stripper head 20 is moved downwardly relative to the mold box 12 to strip the side-by-side blocks B from the mold box, the pallet frame 17 is concurrently moved downwardly to deposit the pallet 18 on the underlying conveyor 16. The conveyor 16, as indicated, includes a pair of laterally spaced apart belts 22, trained around end rolls 24, and supported along their length by idler rolls 26 journaled, via shafts 28, on a frame, generally designated F.

Block height gauging apparatus (FIG. 1), is provided at a block height sensing station 31, downstream of the block making machine 10, and includes a pair of gauging devices, generally designated 29, on opposite sides of the conveyor 16 between belts 22 for measuring or gauging the height of the side-by-side blocks B and indicating any deviation from a predetermined standard. The block height gauging apparatus 30 includes a pair of frame supported, vertically disposed, side bars 32 mounting longitudinally extending, horizontally disposed supports 34.

Mounted on each horizontally disposed support 34 is a horizontally disposed, double acting, solenoid actuated, fluid pressure operated cylinder 38 including an axially movable piston rod 39, having opposite end portions **39*a* and 39*b* extending axially beyond opposite ends of the cylinder 38. Mounted to span opposite ends of each piston rod 39 is a laterally movable, inverted, U-shaped mounting bracket 40. A coil spring 42 is disposed on the inner end 39*a* of the piston rod 39 and reacts between the cylinder 38 and the bracket 40 to bias the piston rod 39 inwardly to the laterally inner position illustrated at the left side of FIG. 1. Each piston rod is retractible to the position illustrated at the right side of FIG. 1**.

Mounted on each bracket 40 for lateral movement therewith, is an upstanding channel 44 provided with internally disposed guides 46 guiding a vertically movable roller supporting rod 48. Mounted at the lower end of the guide rod 48 is a bracket 50, journaling a pallet engaging roller 52. Longitudinally convergent block centering rails 41 are fixed to the inverted, U-shaped mounting brackets 40 on opposite sides of the conveyor for centering the block supporting pallet 18 as it moves downstream in the direction of the arrow *a* (FIG. 2) to the block height sensing station 31.

Since the successive pallets 18 are not all exactly of the same thickness, it is important that the height of the blocks B be gauged from the top surface 18*a* of each pallet, and not the bottom thereof because deviations in the thickness of the pallets 18 will introduce error into the guaged height. For this reason, the pallet sensing rollers 52 engage the top surface 18*a* of each pallet 18. A guide bracket 54 is mounted on each upstanding channel 44 and includes a vertical guide opening 56 for receiving a guide pin 58 which is fixed to the vertically movable roller mounting rod 48. Also, a stop 60 is fixed to the top of each rod 48 for engaging guide 46 and limiting downward movement.

Figure 1:
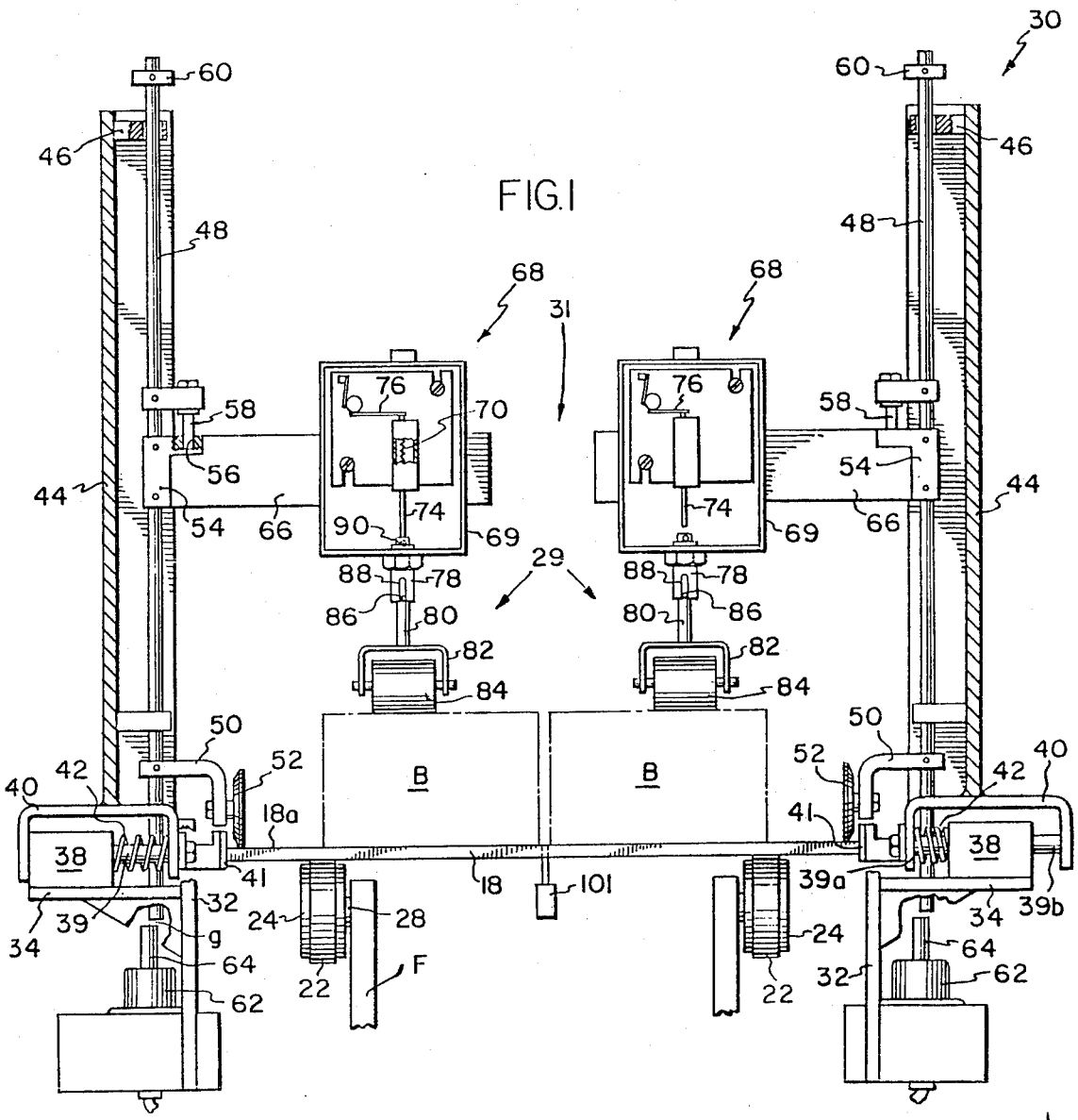
FIG. 1 is a sectional end view of apparatus constructed according to the present invention, taken along the line 1—1 of FIG. 2.

Apparatus is provided for moving the roller mounting rods 48 from the lowered positions, illustrated in FIG. 1, to raised positions, removed from the pallet 18, and comprises a pair of double acting, solenoid actuated, fluid pressure operated cylinders 62, mounted on the side rails 32 and including piston rods 64 having at least portions thereof axially aligned with the guide rods 48. A slight gap *g* is provided between the adjacent ends of the rods 64 and 48 when the cylinder rods 64 are retracted and the rollers 52 engage the top of a pallet.

Fixed to each roller mounting rod 48 at each side of the conveyor is a horizontally supported, mounting bar 66 carrying sensing apparatus, generally designated 68, which is in the path of and engages the tops of the blocks B as they move in a forward path of travel represented by the arrow *a*. The sensing apparatus 68 includes a housing 69 above each block B mounting a variable resistance electrical device 70, such as a rheostat or potentiometer having a linear resistor 71 and a resistor engaging wiper arm 72 (FIG. 3), mounted on a vertically movable actuating rod 74 which may be normally biased downwardly by means such as a leaf spring 76. Mounted on the underside of each housing 69 is a vertical sleeve 78 receiving a roller mounting rod 80 having a clevis 82 fixed to its lower end to journal a block engaging roller 84. A guide pin 86, fixed to the rod 80, is received in a slot 88 on the sleeve 78 for guiding the rod 80 as it moves vertically. A stop pin 90 is fixed to the upper end of each rod 80 to engage housing 69 and maintain it in suspended position.

THE CONTROL CIRCUIT

Figure 2:
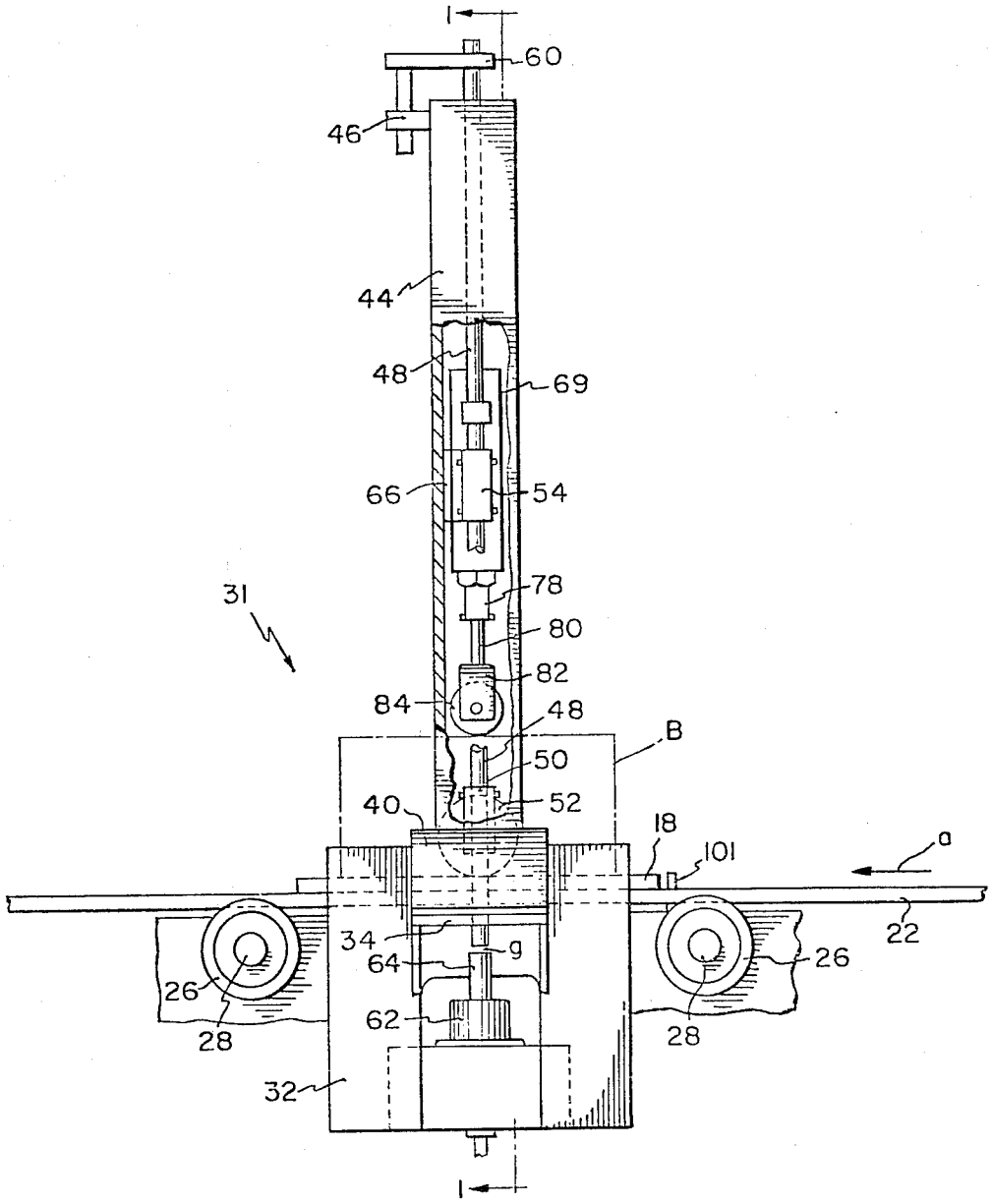
FIG. 2 is a partly sectional, side elevational view of the apparatus illustrated in FIG. 1.

A control system for controlling the apparatus illustrated in FIGS. 1 and 2 is illustrated in FIG. 3, and includes a pair of lines L1 and L2 connected across a suitable source of direct current electrical power. The resistor 70 of each block height gauging device 27 is connected in a typical bridge circuit, generally designated 92, including resistors 93, 94 and 95 connected as usual in bridge circuit relation across lines L3, L4, L5 and L6. The movable potentiometer arm 72, which is mechanically connected to the block engaging roller 84 via the rod 80 is also connected electrically to the line L5. More specifically, and as illustrated in FIG. 3, line L3 is connected between line L1 and the junction of the resistors 94 and 95; line L6 is connected between line L1 and to the junction of the resistors 93 and 70. The opposite sides of a direct current motor M, for controlling the mount of material delivered to the mold box, are connected to lines L4 and L5 which are connected to the junction of the resistors 93 and 94, and to the junction of the resistors 70 and 95, respectively. The motor M, which pivots a discharge gate 96 between the solid and broken line positions shown in FIG. 3, is driven in opposite directions depending upon the condition of unbalance of the bridge circuit 92. The speed of the motor M is dependent upon the degree of unbalance. If the circuit 92 is balanced, the motor M is not driven. The unbalance is, of course, dependent upon the position of the wiper arm 72. The gate 96, which is connected to the motor M by suitable linkage (not shown), selectively tends to close the outlet portion of the hopper 14 and thus controls the amount of material fed to the mold 12. Provided to reciprocate the feed hopper 14 (and gate 96) is a double acting, fluid operated, solenoid controlled power cylinder 97 which, between each block forming operation, removes the hopper 14 to the right in FIG. 3, to a position under a material supply device (not shown) and then returns it to the mold feeding position in which it is shown in FIG. 3. Alternatively, or conjunctively, the motor M could be connected to a screw device mounting stripper 20 to adjust its position relative to the power cylinder or the like, which moves it, and thereby vary the vertical position which it assumes while the mold is being vibrated.

A proximity switch 101 (FIGS. 1 and 2) is provided in the path of the pallets 18 to indicate that a pallet is at the block height sensing station 31 and includes normally open contacts 104 (line L7), normally open contacts 105 (line L5) and normally closed contacts 106 (line L8). The contacts 104 (line L7) are connected in series with a solenoid 62*a* which directs fluid to each cylinder 62 to retract the piston rods 64 and permit the roller support rods 48 and the pallet engaging rollers 52 to lower to the block engaging position illustrated in FIG. 2. The switch 106 (line L8) is connected in series with a solenoid 62*b* which, when energized, will direct fluid to each cylinder 62 in such a direction as to raise its piston rod 64 and move the superjacent roller support rod 48 and roller 52 to a predetermined position above the level of the pallet surface 18*a* when no pallet is at the sensing station.

THE OPERATION

Cementitious material is supplied to the feed box 14, which is moved to a position over a mold 12 having a pallet 18 held against its underside by the pallet frame 17, to discharge the cementitious material into the mold 12. The feed supply box 14 is then withdrawn by cylinder 97 and the stripper head 20 is lowered to compact the material in the mold 12 while the mold 12 is being vibrated. The motor which drives eccentric E is, as usual, connected with a circuit line which includes a contact carried by the stripper head and a vertically aligned contact carried by the mold box. When the stripper head contact, due to compaction of the material, engages the mold box contact, the circuit to the motor driving eccentric E is broken. Thus, when the desired compaction occurs, (as gauged by the contacts engaging) mold box vibration is interrupted and the stripper head 20 continues to move downwardly to move the pallet 18 and pallet support frame 17 downwardly until the pallet 18 is supported by the conveyor 16 which forwardly conveys the blocks B downstream of the mold 12 in the direction represented by the arrow *a*, to the block height sensing station 31.

The piston rods 64 are normally extended to lift the roller supporting rods 48 and the rollers 52 to positions above the level of the pallet surface 18*a*. When the proximity switch 101 is tripped to indicate that a pallet is in position at the gauging station 31, the solenoids 62*a* are energized to lower the piston rods 64 so that the rods 48 and rollers 52 will lower into engagement with the top pallet surface 18*a*. If the blocks B are undersize, they will not move the rollers 84 upwardly. The wiper arms 72 will remain in their lowermost positions to unbalance the circuit in one direction and drive the motor M in such a direction as to pivot the blade 96 in a direction so that additional material will fall into the mold on the subsequent block formation cycle.

If the blocks B are of the proper predetermined height, they will force the rollers 84 and piston rods 80 upwardly to push the rods 74 and the wiper arm 72 upwardly to the position in which the circuit will remain balanced and the motor M will not be driven. A switch 105, provided in line L4, is only closed when the switch 101 is actuated so that the motor M is not driven when blocks B are not in position at the gauging station 31. If blocks B are oversize, the rollers 84 will move the slider 72 to the top of resistor 70 to unbalance the bridge circuits 92 in the opposite direction and drive the motor M in the opposite direction to tend to close the gate 96 and permit less cementitious material to flow into the mold 12 on the subsequent block forming cycle. A galvanometer 110 is connected in parallel with the motor M to provide a visual indication to the operator of the degree of deviation of the height of the block B from a predetermined height. The apparatus is, as described, self-correcting to correct any deviation in the height of the block being formed.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

We claim:

1. In an improved cementitious product making system having a frame means; a product forming mold mounted thereon at a mold station and having a mold cavity for receiving cementitious material; means for presenting cementitious material to said mold means; mechanism mounted by the frame means operably connected to pack material in the mold when cementitious material is supplied thereto, to aid in formation of a product in the mold cavity; product receiving means carried by the frame system for receiving a newly formed product made in the mold and comprising a transfer means and a pallet support surface upon which the product is carried for downstream movement from the molding station; mechanism on the frame system for relatively moving the mold and at least a portion of the product receiving means to release the product from the mold; the improvement comprising: a carrier; means supporting the carrier for vertical movement on the frame means toward and away from the product receiving means; upper and lower sensors, the lower sensor being mounted vertically at the lower end of the carrier at a location to locate on the upper level of the support surface; the upper sensor being supported for vertical movement on the carrier at a location to sense the level of the upper surface of the product; means moving said carrier vertically to move the sensors away from sensing position; gauging mechanism reacting to movement of the upper sensor vertically relative to the lower sensor when the sensors are in sensing position; and a control circuit mechanism connected to the gauging mechanism to respond to the magnitude of such relative vertical movement including circuit means operable in response to movement of said means for engaging the top of said block for controlling said cementitious material presenting means and the amount of material delivered to said mold.

2. Apparatus for gauging the height of a block which is removed from a vibratile mold comprising:

frame means;

means thereon for conveying pallets carrying blocks of cementitious material in a forward path of travel;

support means vertically movable on said frame means between a raised, inoperative position and a lowered position dependent on the level of the top of said pallet; and block height sensing means, mounted on said support means for vertical movement relative thereto to a level dependent upon the height of the formed block and independent of the thickness of the pallet for sensing the level of the top of the block as it moves thereby.

3. The measuring means as set forth in claim 1 wherein said sensing means will remain in a lowered position if said block is undersize, in an uppermost position if said block is oversize, and in an intermediate position if said block is of proper size.

4. The apparatus as set forth in claim 3 including means responsive to said sensing means for indicating any deviation in the height of a measured block from a predetermined height.

5. The apparatus set forth in claim 2 wherein said conveying means moves the formed block past the sensing means, said sensing means being vertically moved by the passing block to a position dependent on the height of the block.

6. Apparatus for gauging the height of a block supported on a pallet comprising:

means for supporting and transporting a block supporting pallet;

carrier frame means mounted for vertical movement between a raised position and a lowered, pallet engaging position, the carrier frame means having a lower pallet engaging member positioned to move vertically, inboard of the edge of the pallet, to engage the top surface of the pallet;

an upper block engageable means mounted on said frame means above said pallet engaging member for engagement with the top of the block and vertical movement to a position dependent on the position of the pallet engaging member and the height of said block; and means responsive to said block engageable means for indicating the deviation of said block height from a predetermined standard to indicate whether any of said blocks are oversize or undersize.

7. In an improved cementitious product making system having a frame means; a product forming mold mounted thereon at a mold station and having a mold cavity for receiving cementitious material; mechanism mounted by the frame means operably connected to pack material in the mold when cementitious material is supplied thereto, to aid in formation of a product in the mold cavity; means for presenting varying volumes of cementitious material to said mold; product receiving means carried by the frame system for receiving a newly formed product made in the mold and comprising a transfer means and a support pallet surface upon which the product is carried for downstream movement from the molding station; mechanism on the frame system for relatively moving the mold and at least a portion of the product receiving means to release the product from the mold; the improvement comprising: gauging carrier means; means, supporting the gauging carrier means at a gauging station, for vertical movements toward and away from the product receiving means from a raised non-gauging position to a lowered gauging position; upper and lower sensors carried thereby, the lower sensor being mounted vertically at a location to locate on the upper level of the support surface, the upper sensor being supported at a laterally inboard location to sense the level of the upper surface of the product; means for moving said carrier means vertically away from lowered gauging position; means for sensing the presence of a product receiving means and a newly molded product at said gauging station and controlling the carrier means to permit its movement down to gauging position; and a control circuit mechanism connected to the upper sensor to respond to variations from a predetermined norm and control the means for presenting cementitious material to said mold in accordance therewith.

* * * * *